US011617405B2

(12) United States Patent
Morgan

(10) Patent No.: US 11,617,405 B2
(45) **Date of Patent: *Apr. 4, 2023**

(54) TRIPLE LAYERED COMPRESSIBLE LINER FOR IMPACT PROTECTION

(71) Applicants: STRATEGIC SPORTS LIMITED, Kowloon (HK); Donald Edward Morgan, Queensland (AU)

(72) Inventor: Donald Edward Morgan, Brisbane (AU)

(73) Assignees: Donald Edward Morgan; Strategic Sports Limited, Hong Kong (HK)

( * ) Notice: Subject to any disclaimer, the term of this patent is extended or adjusted under 35 U.S.C. 154(b) by 233 days.

This patent is subject to a terminal disclaimer.

(21) Appl. No.: 17/026,517

(22) Filed: Sep. 21, 2020

(65) Prior Publication Data

US 2021/0112898 A1 Apr. 22, 2021

Related U.S. Application Data

(63) Continuation of application No. 15/509,906, filed as application No. PCT/IB2015/001526 on Jul. 7, 2015, now Pat. No. 10,806,201.

(30) Foreign Application Priority Data

Sep. 19, 2014 (GB) ..... 1416556

(51) Int. Cl.

| | |
|---|---|
| ***A41D 31/28*** | (2019.01) |
| ***A42B 3/12*** | (2006.01) |
| ***A42B 3/06*** | (2006.01) |
| ***B65D 65/40*** | (2006.01) |

(52) U.S. Cl.

CPC ..... *A41D 31/285* (2019.02); *A42B 3/063* (2013.01); *A42B 3/124* (2013.01); *A42B 3/128* (2013.01); *B65D 65/403* (2013.01)

(58) Field of Classification Search

CPC ..... A41D 31/285; A42B 3/063; A42B 3/124; A42B 3/128

See application file for complete search history.

(56) References Cited

U.S. PATENT DOCUMENTS

| | | | |
|---|---|---|---|
| 4,290,149 | A | 9/1981 | Aileo |
| 4,345,338 | A | 8/1982 | Frieder et al. |
| 4,905,320 | A | 3/1990 | Squyers, Jr. |

(Continued)

FOREIGN PATENT DOCUMENTS

| | | |
|---|---|---|
| CA | 2744519 | 5/2010 |
| CN | 101065168 | 10/2007 |

(Continued)

OTHER PUBLICATIONS

Search Report and Written Opinion for corresponding International Patent Application No. PCT/B2015/001526 dated Jan. 20, 2016.

*Primary Examiner* — Alissa L Hoey
(74) *Attorney, Agent, or Firm* — Reed Smith LLP

(57) ABSTRACT

A compressible liner for a helmet or other apparatus subject to shock loading comprises three substantially co-extensive layers mutually engaged by respective cone-like protuberances and cone-like recesses. The intermediate layer is of a different compressibility and provides for de-coupling of the layers in an oblique impact.

13 Claims, 8 Drawing Sheets

(56) References Cited

U.S. PATENT DOCUMENTS

| | | | | |
|---|---|---|---|---|
| 6,425,141 | B1 | 7/2002 | Cerebrix | |
| 6,610,382 | B1 | 8/2003 | Kobe et al. | |
| 8,850,622 | B2 | 10/2014 | Finiel et al. | |
| 9,545,125 | B2 | 1/2017 | Yoon et al. | |
| 10,668,356 | B2 * | 6/2020 | Bangera | A41D 31/28 |
| 10,798,985 | B2 * | 10/2020 | Manera | A42B 3/063 |
| 2002/0114920 | A1 | 8/2002 | Scholz et al. | |
| 2003/0140400 | A1 | 7/2003 | Ho | |
| 2006/0070170 | A1 | 4/2006 | Copeland et al. | |
| 2006/0070171 | A1 | 4/2006 | Copeland et al. | |
| 2007/0000032 | A1 | 1/2007 | Morgan | |
| 2007/0226881 | A1 | 10/2007 | Reinhard et al. | |
| 2010/0000009 | A1 | 1/2010 | Morgan | |
| 2010/0186150 | A1 * | 7/2010 | Ferrara | F16F 9/0481 2/412 |
| 2010/0299812 | A1 | 12/2010 | Maddux et al. | |
| 2012/0015151 | A1 * | 1/2012 | Pearce | B32B 27/08 264/293 |
| 2012/0198604 | A1 | 8/2012 | Weber et al. | |
| 2012/0317705 | A1 | 12/2012 | Lindsay | |
| 2014/0208486 | A1 | 7/2014 | Krueger | |
| 2015/0223547 | A1 | 8/2015 | Wibbey | |
| 2016/0088884 | A1 | 3/2016 | Guerra | |

FOREIGN PATENT DOCUMENTS

| | | |
|---|---|---|
| CN | 202999446 U | 6/2013 |
| RO | 129619 | 7/2014 |
| WO | 20100001230 | 1/2010 |

* cited by examiner

TRIPLE LAYERED COMPRESSIBLE LINER FOR IMPACT PROTECTION

CROSS REFERENCES TO RELATED APPLICATION

This application is a continuation of, and claims the benefit under 35 U.S.C. § 120 of the earlier filing date of, copending U.S. Ser. No. 15/509,906 filed on Mar. 9, 2017, which is a § 371 of International Application No. PCT/US15/01526, filed Sep. 7, 2015, which claims priority to Great Britain Patent Application No. 1416556.7 filed on Sep. 19, 2014.

FIELD OF THE INVENTION

This invention relates to a compressible liner for impact protection, and to a method of impact protection using a compressible liner. The invention may be used in a helmet or the like.

BACKGROUND OF THE INVENTION

Compressible liners are used in helmets to provide cushioning upon impact. Such liners may also be used wherever a structure or apparatus may be at risk from shock loading, for example in relation to motor vehicles; baby capsules; protective clothing, such as vests; packing materials and protection of valuable goods in transit.

WO2010/001230A discloses an example of a compressible liner having dual compressible layers with mutually engageable cone-shaped projections and recesses; the layers comprise foam materials of different compressibility.

Analysis of impacts, particularly helmet impacts, shows that typical impact forces are both translational and rotational. The translational force is generally orthogonal to the impact surface, and in the case of a helmet causes a rapid deceleration which is required to be cushioned in order to remove impact energy.

The rotational impact force is more complex, and in an oblique impact causes an acceleration due to frictional contact, for example between a helmet and the contact surface. It is desirable for the liner to minimize both this acceleration and the inevitable deceleration that follows, to the intent that, for example, energy imparted to the head and neck of a helmet wearer is minimized. Similar considerations apply to non-helmet applications undergoing an oblique impact.

What is required is a compressible liner which better accommodates an oblique impact.

SUMMARY OF THE INVENTION

According to the invention there is provided a compressible liner for impact protection, said liner comprising three substantially co-extensive layers mutually engaged by respective arrays of cone-like protuberances and corresponding cone-like recesses, the outer surface of the liner being substantially smooth and the intermediate layer having a different compressibility to that of an adjacent layer.

In the invention, an intermediate layer having portions of different compressibility is envisaged. Accordingly a portion of the intermediate layer may have a different compressibility to that of an adjacent layer, or the intermediate layer may be of uniform compressibility.

The invention is characterized by providing that the intermediate layer (or a portion thereof) is of a different compressibility to that of the inner and outer layers, or that the intermediate layer (or a portion thereof) is of a different compressibility to an adjacent layer. Alternatively the invention may be characterized by the intermediate layer (or a portion thereof) having a different density to that of the inner and outer layers, or by the intermediate layer (or a portion thereof) having a different density to that of an adjacent layer.

One configuration of the invention comprises an inner layer of low density, an intermediate layer of density greater than the inner layer and the outer layer density greater than the intermediate layer thereby producing an increasing density configuration from the inner layer to the outer layer (i.e. a compression or crushing gradient).

Another configuration of the invention comprises an inner layer of a certain density, an intermediate layer of density lower than the inner layer and an outer layer of density greater than the inner layer and the intermediate layer. The intermediate 'softer' layer would have a decoupling effect on the inner and outer layer and act as a 'crumple zone' between the two layers (i.e. the low density 'softer' intermediate foam layer would reduce the transfer of impact energy from the outer layer to the inner layer and vice versa).

Another configuration of the invention comprises an inner layer and an outer layer of low density foam and the intermediate layer made of higher density foam. This configuration is suitable for use in, for example, body vests for footballers exposed to different levels of impact tackling, where the three layered liner could be used to soften the blow to the body of the player wearing the vest (being tackled) and soften the blow to the body of the player (the tackler) coming in contact with the vest. The intermediate layer of the higher density foam will act like a decoupling zone between the two softer layers, allowing a small amount of shear with respect to the inner layer which remains stationary with respect to the head.

It will be understood that many additional combinations are possible, in addition to variation of the shape, size and spacing of the protuberances and recesses. The protuberances may have a base which is circular, triangular, square or having a greater number of sides. A symmetrical protuberance is preferred.

It will also be noted that the interlocking structure of the inner cones embedded within the cones of the overlying intermediate layer and the intermediate cones embedded within the thickness of the overlying outer layer produces a stronger shock absorbing liner that would prevent shearing effects of layers during oblique impacts.

A further feature of the invention is to allow the incorporation of segmentation/zoning of the inner and intermediate layers, and the outer layer constructed of one piece. The use of segmentation/zoning of the inner and intermediate layers allows the combinations of different density foams close to the vulnerable areas of the skull to be of different thicknesses and strengths. Typically such segmentation allows compressibility of four regions to be selected, namely front, back, top and sides.

The three layered shock absorbing liner of the invention can be used in all kinds of helmets and applications where it is required to absorb different levels of impact forces. The thickness thereof may be in the range 20-50 mm, according to the use for which the liner is intended.

The combination of lower density foams incorporated within the thickness of the three layers produces a lighter helmet thereby reducing rotational acceleration effects of the head during impacts (thus reducing the potential of focal and diffuse head injuries).

The combination of three different densities incorporated within the thickness of the three layers provides a liner to:

I. Absorb different levels of impact forces more efficiently thereby reducing the risk of concussion at low level impacts and more severe head injuries at high level of impacts.

II. Direct impact energy sideways away from the brain (in a helmet liner) thereby lowering g-forces to the head.

III. Reduce slab-cracking.

Other features of the invention will be apparent from the claims appended hereto.

BRIEF DESCRIPTION OF DRAWINGS

Other features of the invention will be apparent from the following description of a preferred embodiment illustrated by way of example only in the accompanying drawings in which.

DETAILED DESCRIPTION OF THE PREFERRED EMBODIMENT

Figure 1:
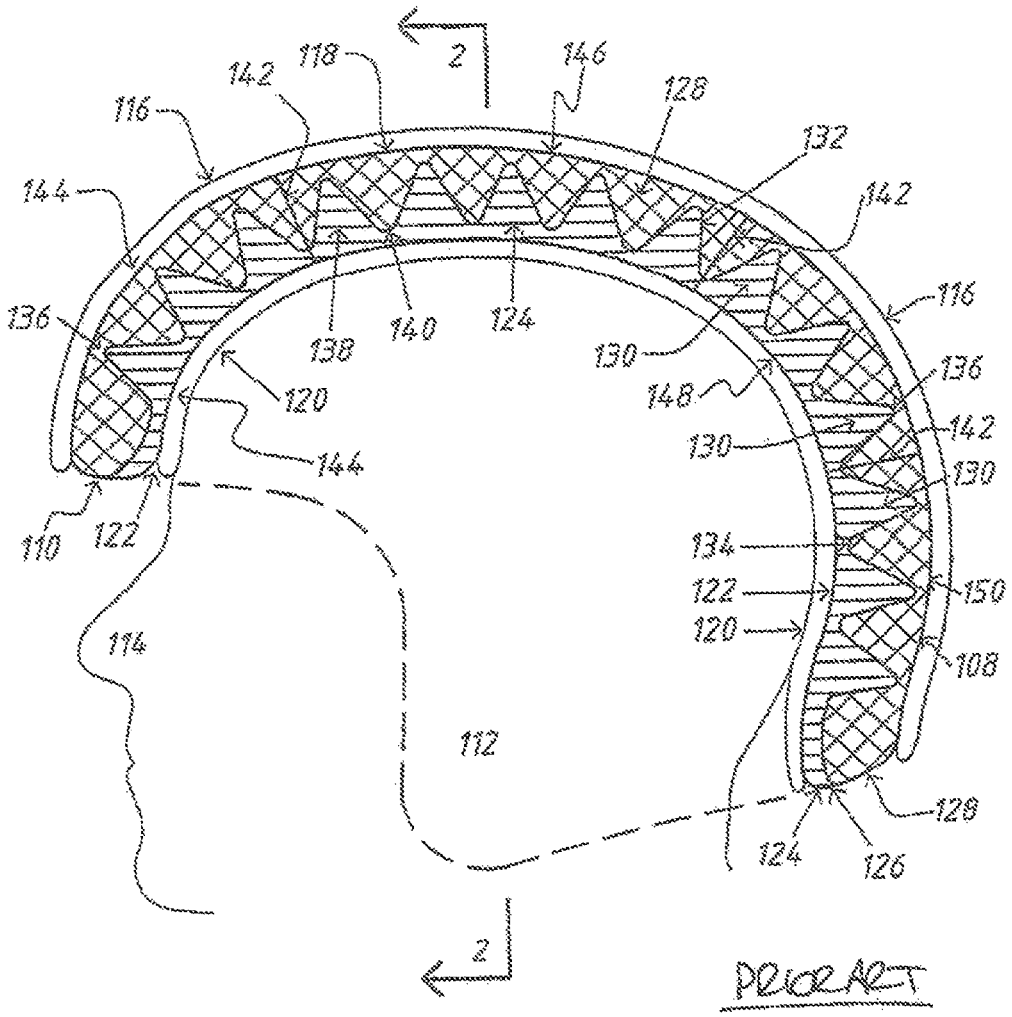
FIG. 1 illustrates a transverse vertical section through a prior art helmet having a compressible liner.
Figure 2:
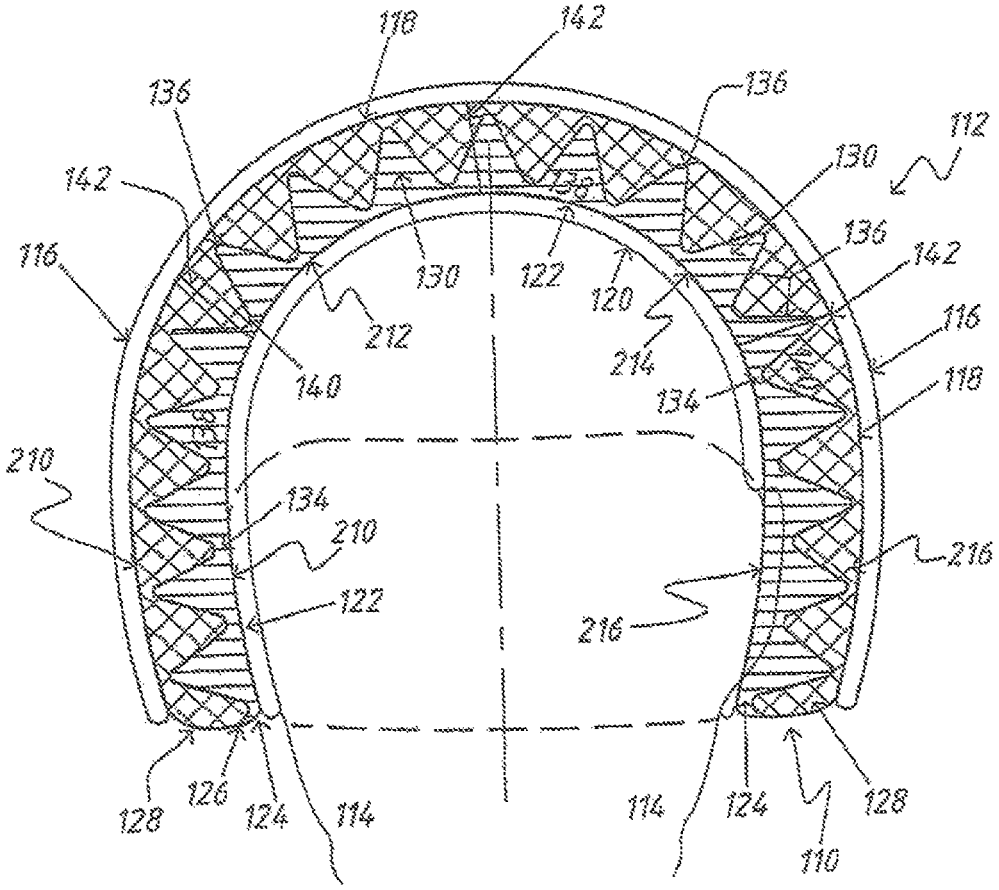
PRIOR ART FIG 2
FIG. 2 corresponds to FIG. 1 and shows an orthogonal section on line 2-2 of FIG. 1.
Figure 3:
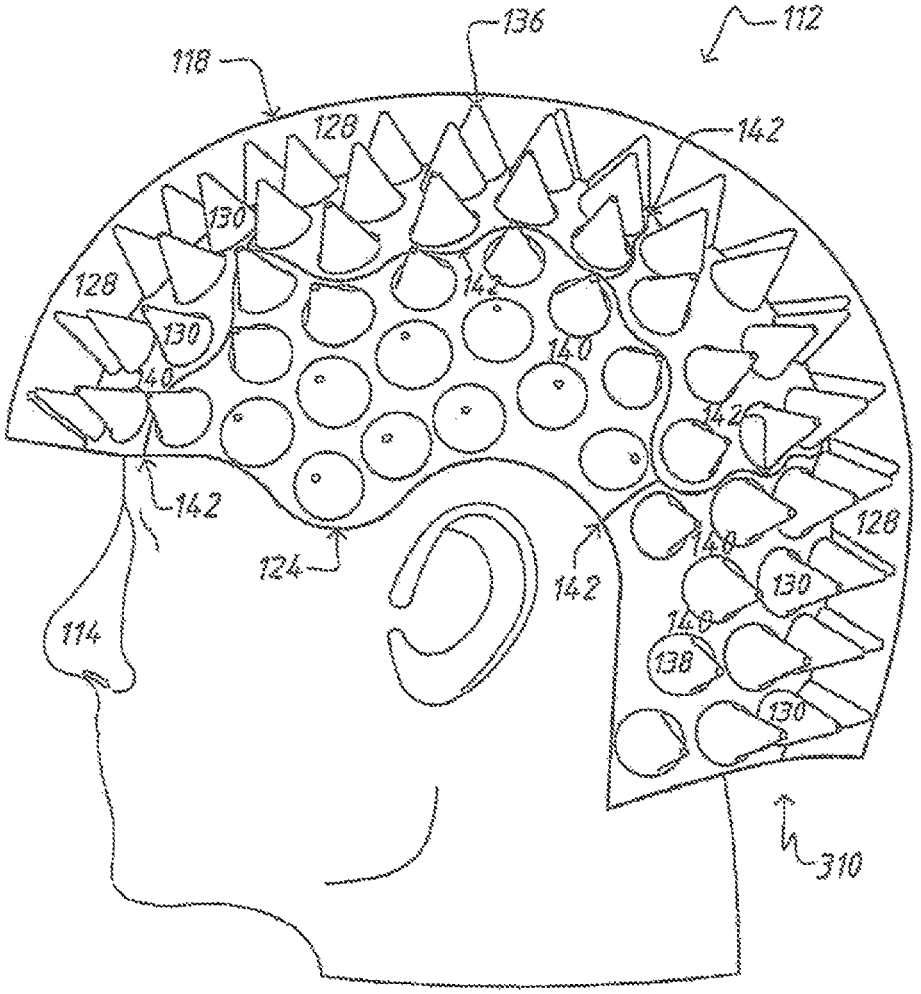
FIG 3 PRIOR ART
FIG. 3 illustrates in part the inner liner of FIGS. 1 and 2, showing a regular array of outwardly directed conical protuberances.

FIGS. 1-3 illustrate the helmet of WO 2010/001230A.

A helmet 112 comprises an outer shell 116, typically of a hard plastics material, within which is provided a double compressible layer 124, 128 and an optional soft internal comfort liner 120.

As best illustrated in FIG. 3, the inner compressible layer 124 comprises an array of integral conical protuberances 130 which fit closely within corresponding conical recesses 132 of the outer compressible layer 128. The materials of the layers 124, 128 are of different compressibility, which gives an advantageous compression characteristic as compared with a conventional unitary liner of single compressibility.

Particular details of the prior art construction can be obtained by reference to the description of WO 2010/001230A, and will not be further described here.

The invention will be described with reference to a helmet 1112, indicated in phantom in FIG. 8 and in solid lines in FIG. 9, having an outer shell 1116 and an optional soft internal comfort liner 1120, of the kind illustrated in FIGS. 1-3, it being understood that the compressible liner of the invention may be used in apparatus other than helmets, as previously mentioned.

Figure 4:
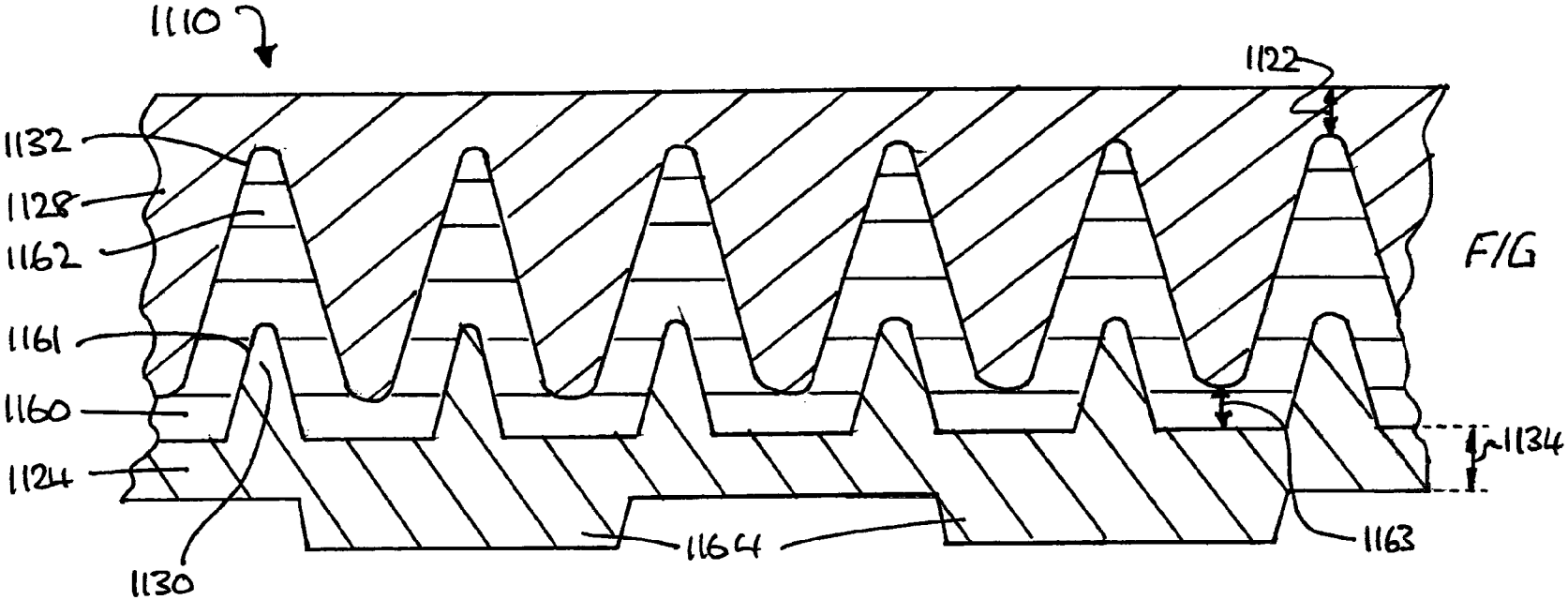
FIG. 4 illustrates a straight section of a compressible liner according to a first embodiment of the invention.

FIG. 4 illustrates a first embodiment of the invention. A compressible liner 1110 comprises an inner layer 1124, an outer layer 1128 and an intermediate layer 1160. The inner layer 1124 has many protuberances 1130 which project into matching recesses 1161 of the intermediate layer 1160, and the intermediate layer has many protuberances 1162 which project into matching recesses 1132 of the outer layer 1128. The protuberances 1130, 1162 and corresponding recesses 1161, 1132 are integrally formed from a respective base region 1134, 1163 of relatively uniform thickness, and may have variability in size, shape and spacing, though, as illustrated in this embodiment, the protuberances of the inner and intermediate layers are uniform. In this example the outer layer has a continuous surface layer 1122 of relatively uniform thickness. The inner layer also includes inwardly facing projections or ribs 1164 to engage a comfort liner, but the inner surface may also be smooth.

Each of the three layers 1124, 1128, 1160 typically comprises a shock absorbing expanded polystyrene material (or other suitable thick absorbing material as previously described). The layers may be respectively homogeneous. Adjacent layers are of different compressibility so as to permit greater variation in the compression and crushing gradients across the thickness of the liner 1110. As will be appreciated the invention permits three different densities of material in three different layers (i.e. a factorial three possibility) which provides many more potential combinations than the prior art, but maintaining a comparatively low manufacturing cost.

Figure 5:
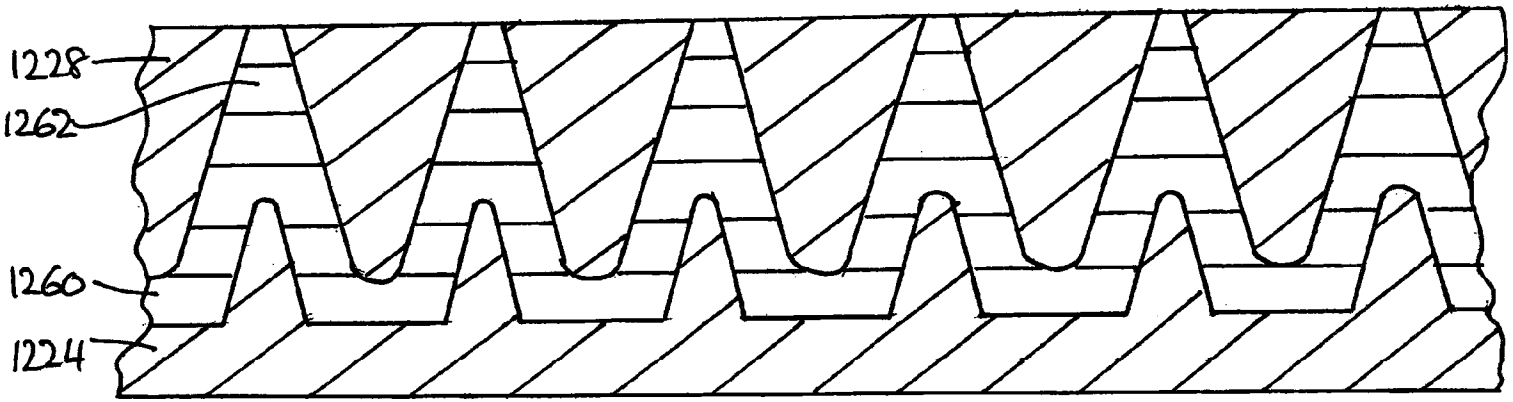
FIG. 5 corresponds to FIG. 4 and illustrates a second embodiment of the invention.

An alternative embodiment is illustrated in FIG. 5, to show a degree of variation which is possible with the invention. In FIG. 5, the inner and outer layers 1224, 1228 have the same compressibility, whereas the intermediate layer 1260 is different. Furthermore the underside of the inner layer 1224 is planar, and at the outer side, the peaks of the protuberances 1262 of the intermediate layer 1260 are permitted to appear through the outer layer 1228, thus permitting a substantial sharing of an orthogonal impact load.

In both embodiments of FIGS. 4 and 5, it will be understood that a straight liner is shown for ease of illustration, but that in practice a three-dimensional form may be required as in the case of the helmet liner illustrated in FIGS. 1-3.

Figure 6:
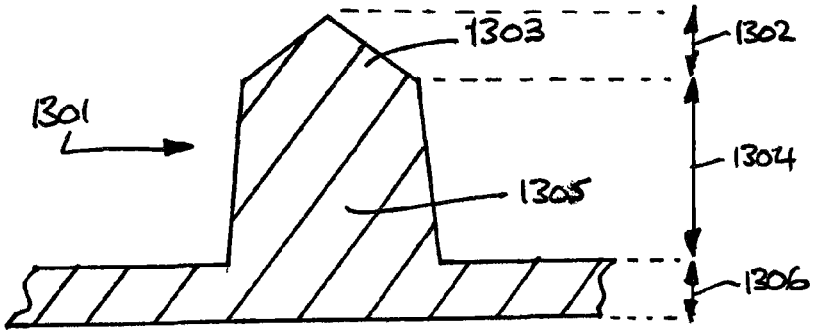
FIGS. 6 and 7 show alternative conical forms for use in the invention.
Figure 7:
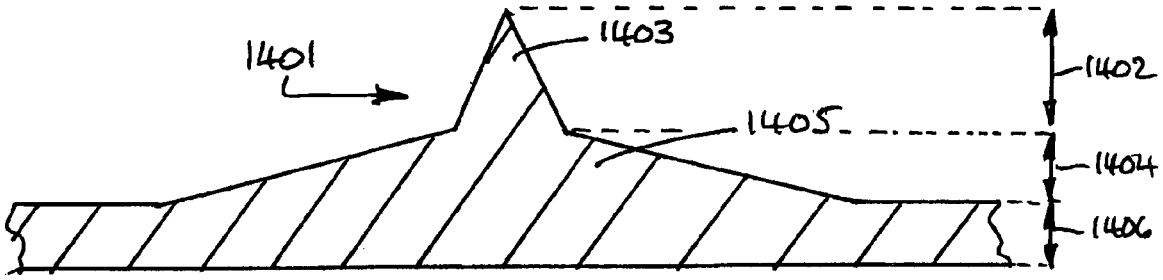

FIGS. 6 and 7 illustrate two examples of different shapes of protuberance 1301, 1401 which allow the material of the protuberance to have a changing effect as the degree of compression increases. It will be understood that a corresponding recess is provided in the adjacent layer.

In FIG. 6, a broad protuberance 1301 has a first portion 1302 comprising a regular conical tip 1303 with an included angle in the range 80-120°. A second portion 1304 comprises a regular circular supporting pillar 1305 which constitutes the main body of the protuberance, and has a slight outward taper in the range 5-15° towards the base. The first portion 1302 has an axial height which is about 25% of the total height of the protuberance. In this embodiment the base region 1306 is of substantially constant thickness across the layer.

The protuberance 1301 exhibits a resistance to compression which increases quickly over the tapering point 1303. The main body 1305 of the protuberance is of substantially constant section, and exhibits substantially increased stiffness. The shaft taper of the main body ensures a snug fit in the corresponding recess.

In FIG. 7, a slim protuberance 1401 also has a first portion 1402 comprising a regular conical tip 1403 with an included angle in the range 30-60°. A second portion 1404 comprises a tapering shallow frustoconical base 1405 having an included angle in the range 120-160°. The first portion 1402 has a height which is in the range 75-125% of that of the second portion 1404. As illustrated the height of the first portion 1402 is greater than that of the second portion 1404. In this embodiment the base region 1406, as before is a substantially constant thickness across the layer.

The protuberance 1401 exhibits a resistance to compression at the tapering point 1403 which is slight. The main body 1403 of the protuberance permits only further compression before the entire base thickness 1404 is engaged to resist compression. It will be appreciated that the protuberance 1401 squashes down more readily than the protuberance 1301.

Figure 8:
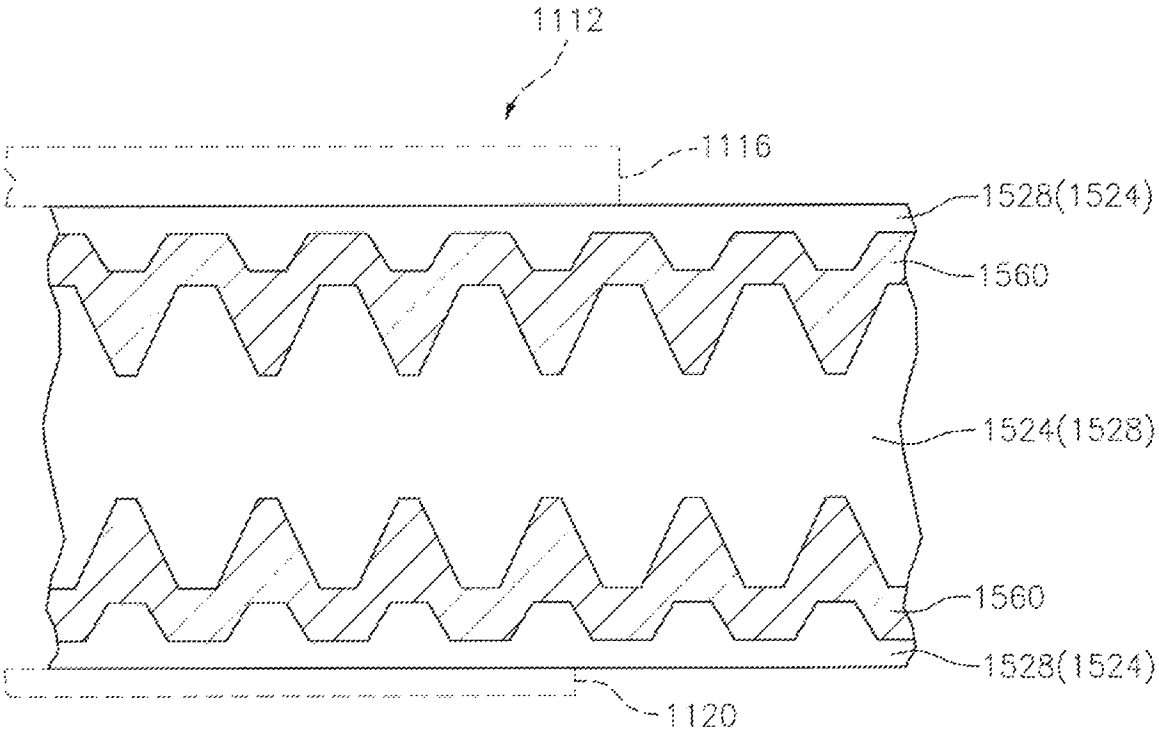
FIG. 8 shows a dual version of the compressible liner of the invention.

FIG. 8 illustrates a double compressible liner, of the kind shown in FIG. 4, incorporating the triple layered construction of the present invention whereby a common inner layer 1524 is surmounted by respective intermediate layers 1560 and outer layers 1528 on either side. In the embodiment of FIG. 8 it will be understood that the inner layer 1524 may be constituted by a single component such as a one-piece moulding, or may comprise two inner layers of single compressible liners placed back to back and secured together, if required, by any suitable means. This embodiment may also be characterised on a common outer layer (placed innermost) surmounted by respective intermediate and inner layers.

FIGS. 9-15 illustrate the variety of configurations which are possible with the interlocking structure of the present invention, by reference to a curved liner (for example for a helmet).

Figure 9:
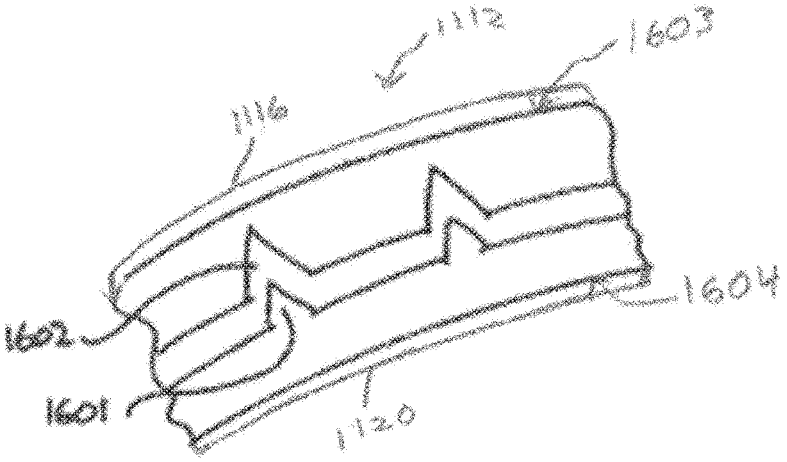
FIGS. 9-15 illustrate the variety of configurations which are possible with the interlocking structure of the present invention, by reference to a curved liner (for example for a helmet).

FIG. 9 illustrates three layers with relatively small inner cones 1601 aligned with somewhat larger outer cones 1602, the outer cones being somewhat inward of a smooth outer surface 1603, and the inner surface 1604 being also smooth.

Figure 10:
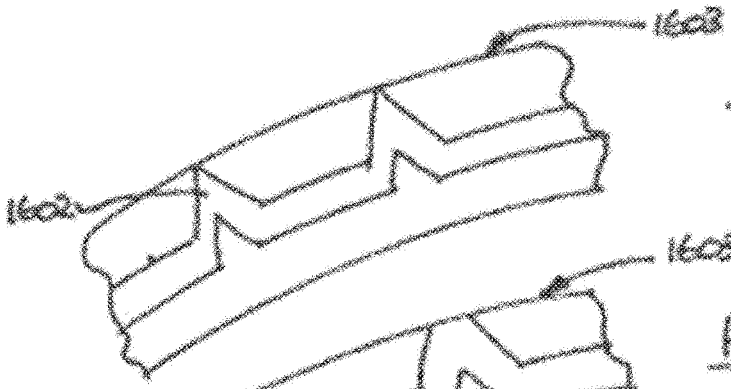

FIG. 10 corresponds to FIG. 9, but in this case the outer cones 1602 just reach the outer surface 1603.

Figure 11:
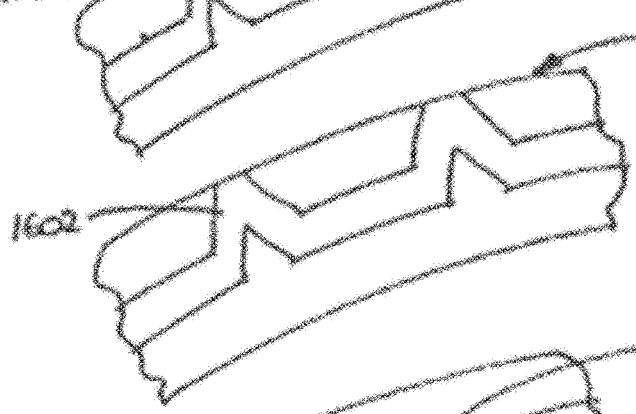

FIG. 11 corresponds to FIGS. 9 and 10, but in this case the outer cones 1602 appear in truncated form on the outer surface 1603.

Figure 12:
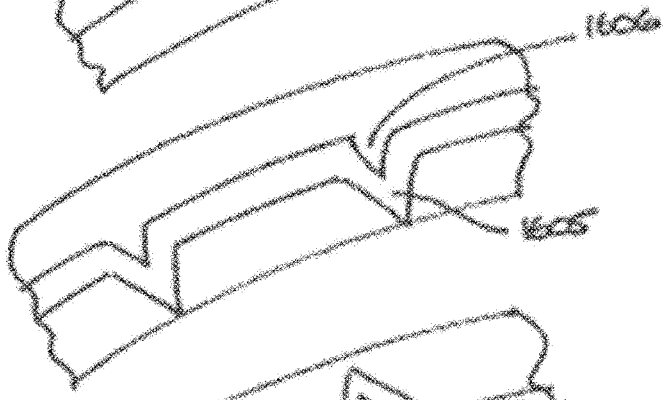

FIG. 12 illustrates a reversed cone arrangement, corresponding to FIG. 10, with the inner and outer cones 1605, 1606 facing inwardly. A reversed arrangement corresponding to FIGS. 9 and 11 is also possible.

Figure 13:
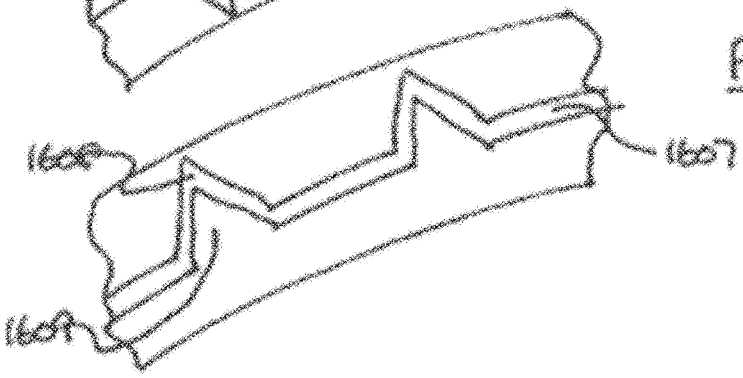

FIG. 13 corresponds to FIG. 9, and illustrates a somewhat narrower intermediate layer 1607 having outer cones 1608 of reduced wall thickness; the inner cones 1609 are of somewhat greater height than those illustrated in FIG. 9.

Figure 14:
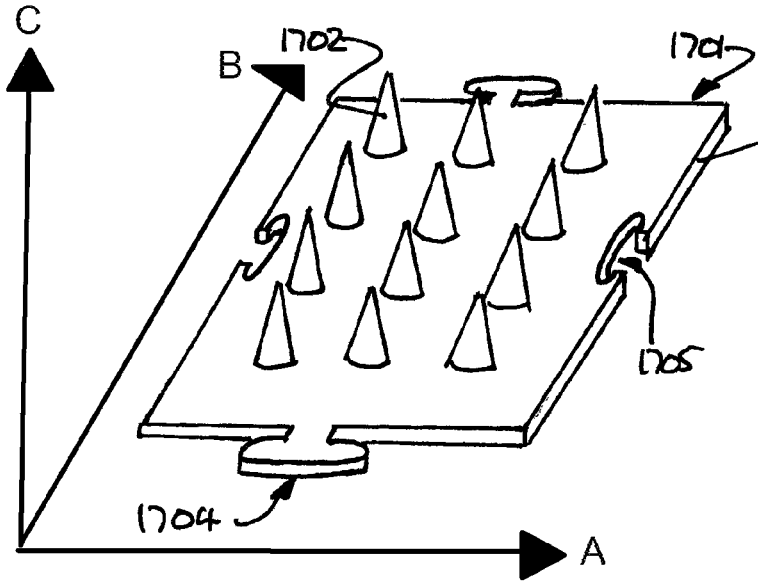

FIG. 14 illustrates one element 1701 of an inner or intermediate layer, having cones 1702 in a regular pattern. The edges 1703 of the element 1701 have a male or female locking form or key 1704, 1705 whereby adjacent elements can be retained together against transverse forces, in the manner of a jigsaw puzzle. It will be appreciated that the arrangement of FIG. 14 permits adjacent elements to be of different material, different size and/or different compressibility. The element of FIG. 14 is rectangular, but this aspect of the invention is not limited to edge shape—curved and non-regular shapes are possible, and may be necessary for a helmet liner. The outer layer (not shown) is one piece. Axes A and B correspond to the transverse and longitudinal directions, whereas axis C indicates the through thickness or material thickness of the layer.

Figure 15:
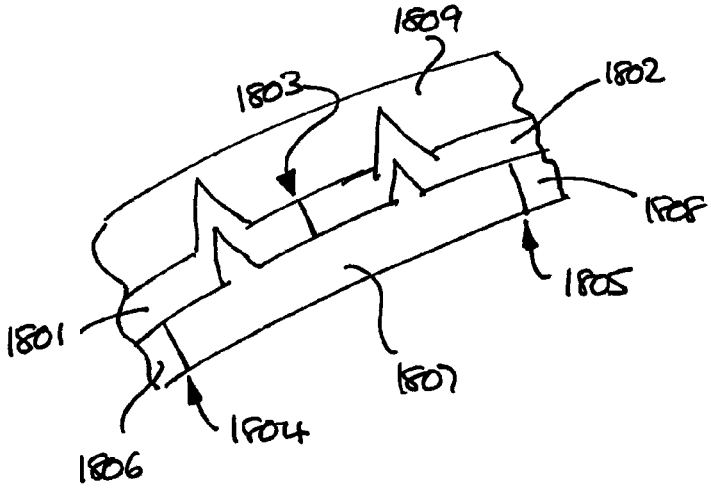

FIG. 15 illustrates how adjacent elements 1801, 1802 of an intermediate layer have a junction 1803 which does not correspond with junctions 1804, 1805 between adjacent elements 1806, 1807, 1808 of an inner layer. Such an arrangement provides a more stable and strong construction. The outer layer 1809 is one piece.

In the variations disclosed in FIGS. 9-13, the cones have substantially the same apex angle, it will however be understood that the inner and outer cones may have a different apex angle, and/or be different between adjacent keyed elements.

The invention comprises layers whose comparative densities (or portions thereof) may be characterized as follows ('a' being the outer layer; 'b' being the intermediate layer, and 'c' being the inner layer):

a>b>c, or a>c>b, or b>a>c, or b>c>a, or c>b>a, or c>a>b, or (a=c)>b, or (a=c)<b.

It follows that the respective compressibilities are:

c>b>a, or b>c>a, or c>a>b, or a>c>b, or a>b>c, or b>a>c, or (a=c)<b, or (a=c)>b.

Densities of the respective layers (or portions thereof) are in the following ranges:

a 35-110 $kgm^{-3}$ b 15-100 $kgm^{-3}$ c 15-90 $kgm^{-3}$

In an embodiment of the invention, the materials of the respective layers are foam expanded polystyrene and/or a viscoelastic foam material. The material may be isotropic (having a material property that is identical in all directions) or anisotropic (having a material property that preferentially shears in one direction) to give a shearing in the direction substantially parallel to the layer direction.

Thicknesses of the respective layers in a helmet gives an overall thickness in the range 15-45 mm, but is typically in the range 20-30 mm. The three layers may each have a uniform thickness, which may not be equal between layers, or may have a varying thickness.

EXAMPLE

A comparative impact test using a variety of anvil shapes and ambient conditions has been carried out, with the following characteristics and results.

A 'standard' single layer liner had a thickness of 30 mm and consisted of expanded polystyrene foam with a density of about 60 $kg/m^3$.

A triple layer liner according to the invention had an average thickness of 30 mm (25 mm to 35 mm) and consisted of expanded polystyrene foam having an outer layer density of 60 $kg/m^3$. The middle layer had bigger cones than the inner layer. The density of the cones of the middle layer at the front, back and sides was 55 $kg/m^3$, whereas on the top the density was 40 $kg/m^3$. The density of the cones of the inner layer at the front, back and sides was 45 $kg/m^3$, whereas on the top the density was 40 $kg/m^3$ (the same as the corresponding cones of the middle layer).

TABLE 1

| Ref No. | Anvil Shape | Test Conditions | Helmet Angle | Height above base of Helmet (mm) | Standard Liner Compression (mm) Test 1 | Standard Liner Compression (mm) Test 2 | Triple Liner Compression (mm) Test 1 | Triple Liner Compression (mm) Test 2 |
|---|---|---|---|---|---|---|---|---|
| 1 | Flat | Ambient | 0 | 300 | 21.6 | 21.7 | 27.3 | 27.6 |
| 2 | Flat | Hot | 180 | 140 | 15.0 | 14.3 | 17.8 | 18.1 |
| 3 | Hemispherical | Cold | Right 125 | 160 | 23.4 | 23.5 | 26.0 | 26.1 |
| 4 | Flat | Wet | Right 120 | 180 | 20.2 | 19.4 | 23.0 | 22.5 |

The helmet angle is the rotational position of the impact, with respect to the anvil; front being 0°, rear being 180° and so on. The test helmet in which the comparative liners were tested at a standard impact, and included a dummy head of appropriate size and mass (about 5 kg in total). Impacts were in each case translational. For impacts where the helmet was dropped onto a flat steel anvil, the drop height was 1.92 m and for impacts onto hemispherical anvil, the drop height was 1.43 m.

It may be seen by comparison that the triple layer liner according to the invention provided a substantial percentage improvement (i.e. increased compression) over a single layer liner of the same thickness.

The comparative g-forces measured during the tests exemplified in Table 1 are as follows:

TABLE 2

| Ref No. | Standard Liner Test 1 | Standard Liner Test 2 | Triple Liner Test 1 | Triple Liner Test 2 |
|---|---|---|---|---|
| 1 | 151.6 | 163.8 | 126.7 | 134.4 |
| 2 | 94.1 | 98.2 | 79.6 | 78.3 |
| 3 | 100.5 | 97.7 | 84.2 | 86.9 |
| 4 | 181.5 | 202.3 | 140.7 | 166.1 |

The substantial reduction in measured g-force can be clearly seen, and hence the effectiveness of the triple layer liner of the invention.

A comparative table of the mass of the respective helmets under test now follows:

TABLE 3

| Test Conditions | Standard Liner (g) | Triple Inner (g) |
|---|---|---|
| Ambient | 275 | 224 |
| Hot | 277 | 225 |
| Cold | 277 | 227 |
| Wet | 280 | 227 |

This comparison clearly shows that the triple layer liner of the invention results in a lighter helmet, typically around 18% less mass.

By way of illustration an alternative triple layer liner of expanded polystyrene foam could have the following density characteristics:

Outer layer: uniform 70 kg/m$^3$

Middle layer: top 50 kg/m$^3$; front 55 kg/m$^3$; back 60 kg/m$^3$; side 65 kg/m$^3$;

Inner layer: top 30 kg/m$^3$; front 35 kg/m$^3$; back 40 kg/m$^3$; side 45 kg/m$^3$.

Although the invention has been herein shown and described in what is conceived to be the most practical and preferred embodiments, it is recognized that departures can be made within the scope of the invention, which are not to be limited to the details described herein but are to be accorded the full scope of the appended claims so as to embrace any and all equivalent assemblies, devices and apparatus.

What is claimed is:

1. A helmet comprising:

an outer shell;

an inner liner; and a compressible liner disposed between the outer shell and the inner liner, said compressible liner comprising:

three co-extensive layers comprising an intermediate layer between a first layer and a second layer, wherein the first layer comprises a first array of cone-like protuberances, wherein the intermediate layer comprises a first array of cone-like recesses;

wherein the cone-like protuberances in the first array of cone-like protuberances in the first layer project into corresponding cone-like recesses in the first array of cone-like recesses in the intermediate layer, wherein the intermediate layer further comprises a second array of cone-like protuberances, wherein the cone-like recesses in the first-array of cone-like recesses in the intermediate layer extend within the cone-like protuberances in the second array of cone-like protuberances in the intermediate layer, wherein the second layer comprises a second array of cone-like recesses;

wherein the cone-like protuberances in the second array of cone-like protuberances in the intermediate layer project into corresponding cone-like recesses in the second array of cone-like recesses in the second layer, wherein an outer surface of the compressible liner is smooth and continuous; and wherein at least one of said co-extensive layers has a different at least one of compressibility and density to that of an adjacent layer of said co-extensive layers;

wherein said co-extensive layers are each configured as one-piece and selected from foam expanded polystyrene and viscoelastic foam.

2. A helmet according to claim 1, wherein the second layer has a density in a range from 35-110 kgm$^{-3}$, the intermediate layer has a density in a range from 15-100 kgm$^{-3}$, and the first layer has a density in a range from 15-90 kgm$^{-3}$.

3. A helmet comprising:

an outer shell;

an inner liner; and a compressible liner disposed between the outer shell and the inner liner, said compressible liner comprising:

three co-extensive layers comprising an intermediate layer between an inner layer and an outer layer, each of the intermediate, the inner and the outer layer comprising respective arrays of cone-like protuberances and corresponding cone-like recesses;

wherein the three layers are mutually engaged by the respective arrays of cone-like protuberances and corresponding cone-like recesses;

wherein an outer surface of the compressible liner is smooth and continuous;

wherein at least one of said co-extensive layers has a different at least one of compressibility and density to that of an adjacent layer of said co-extensive layers;

wherein the cone-like protuberances in the inner layer and the intermediate layer protrude in the direction of the outer layer;

wherein the cone-like protuberances in the inner layer and the intermediate layer fall short of the outer surface of the outer layer;

wherein the cone-like protuberances in the inner layer and the intermediate layer are selected from cones with conical tips and cones with truncated tips;

wherein said co-extensive layers are each configured as one-piece and selected from foam expanded polystyrene and viscoelastic foam.

4. A helmet comprising:

an outer shell;

an inner liner; and a compressible liner disposed between the outer shell and the inner liner, said compressible liner comprising:

three co-extensive layers comprising an intermediate layer between an inner layer and an outer layer, each of the intermediate, the inner and the outer layer comprising respective arrays of cone-like protuberances and corresponding cone-like recesses;

wherein the three layers are mutually engaged by the respective arrays of cone-like protuberances and corresponding cone-like recesses;

wherein an outer surface of the compressible liner is smooth and continuous;

wherein one of said three co-extensive layers has a different at least one of compressibility and density to that of an adjacent layer of said three co-extensive layers;

wherein the cone-like protuberances in the inner layer and the intermediate layer protrude in the direction of the outer layer;

wherein the cone-like protuberances in the inner layer fall short of the outer surface of the outer layer;

wherein the cone-like protuberances in the intermediate layer are contiguous with the outer surface of the outer layer;

wherein the cone-like protuberances in the intermediate layer are selected from cones with conical tips and cones with truncated tips;

wherein said co-extensive layers are each configured as one-piece and selected from foam expanded polystyrene and viscoelastic foam.

5. A helmet comprising:

an outer shell;

an inner liner; and a compressible liner disposed between the outer shell and the inner liner, said compressible liner comprising:

three co-extensive layers comprising an intermediate layer between an inner layer and an outer layer, each of the intermediate, the inner and the outer layer comprising respective arrays of cone-like protuberances and corresponding cone-like recesses;

wherein the three layers are mutually engaged by the respective arrays of cone-like protuberances and corresponding cone-like recesses;

wherein an outer surface of the compressible liner is smooth and continuous;

wherein one of said co-extensive layers has a different at least one of compressibility and density to that of an adjacent layer of said co-extensive layers;

wherein the cone-like protuberances in the outer layer and the intermediate layer protrude in the direction of an inner surface of the inner layer;

wherein the cone-like protuberances in the outer layer and the intermediate layer fall short of the inner surface of the inner layer;

wherein the cone-like protuberances in the outer layer and the intermediate layer are selected from cones with conical tips and cones with truncated tips;

wherein said co-extensive layers are each configured as one-piece and selected from foam expanded polystyrene and viscoelastic foam.

6. A helmet comprising:

an outer shell;

an inner liner; and a compressible liner disposed between the outer shell and the inner liner, said compressible liner comprising:

three co-extensive layers comprising an intermediate layer between an inner layer and an outer layer, each of the intermediate, the inner and the outer layer comprising respective arrays of cone-like protuberances and corresponding cone-like recesses;

wherein the three layers are mutually engaged by the respective arrays of cone-like protuberances and corresponding cone-like recesses;

wherein an outer surface of the compressible liner is smooth and continuous;

wherein one of said co-extensive layers has a different at least one of compressibility and density to that of an adjacent layer of said co-extensive layers;

wherein the cone-like protuberances in the outer layer and the intermediate layer protrude in the direction of the inner layer;

wherein the cone-like protuberances in the outer layer fall short of an inner surface of the inner layer;

wherein the cone-like protuberances in the intermediate layer are contiguous with the inner surface of the inner layer;

wherein the cone-like protuberances in the intermediate layer are selected from cones with conical tips and cones with truncated tips;

wherein said co-extensive layers are each configured as one-piece and selected from foam expanded polystyrene and viscoelastic foam.

7. A helmet comprising:

an outer shell;

an inner liner; and a compressible liner disposed between the outer shell and the inner liner, said compressible liner comprising:

five co-extensive layers comprising a core central layer, an upper intermediate layer, an upper outer layer, a lower intermediate layer and a lower outer layer, each of the upper and lower sides of the core layer, the upper intermediate layer, the upper outer layer, the lower intermediate layer and the lower outer layer comprising respective arrays of cone-like protuberances and corresponding cone-like recesses;

wherein the five layers are mutually engaged by the respective arrays of cone-like protuberances and corresponding cone-like recesses, such engagement achieved through the engagement of the upper side of the core layer, the upper intermediate layer and the upper outer layer, and the lower side of the core layer, the lower intermediate layer and the lower outer layer;

wherein the core layer comprises a first array of cone-like protuberances on its upper side, wherein the upper intermediate layer comprises a first array of cone-like recesses, wherein the cone-like protuberances in the first array of cone-like protuberances in the upper side of the core layer project into corresponding cone-like recesses in the first array of cone-like recesses in the upper intermediate layer;

wherein the upper intermediate layer further comprises a second array of cone-like protuberances, wherein the core upper layer comprises a second array of cone-like recesses, wherein the cone-like protuberances in the second array of cone-like protuberances in the upper intermediate layer project into corresponding cone-like recesses in the second array of cone-like recesses in the core upper layer;

wherein the upper intermediate layer further comprises a third array of cone-like protuberances, wherein the upper outer layer comprises a third array of cone-like recesses, wherein the cone-like protuberances in the third array of cone-like protuberances in the upper intermediate layer project into corresponding cone-like recesses in the third array of cone-like recesses in the upper outer layer;

wherein the upper outer layer comprises a fourth array of cone-like protuberances, wherein the upper intermediate layer comprises a fourth array of cone-like recesses, wherein the cone-like protuberances in the fourth array of cone-like protuberances in the upper outer layer project into corresponding cone-like recesses in the fourth array of cone-like recesses in the upper intermediate layer;

wherein the core layer comprises a fifth array of cone-like protuberances on its lower side, wherein the lower intermediate layer comprises a fifth array of cone-like recesses, wherein the cone-like protuberances in the fifth array of cone-like protuberances in the lower side of the core layer project into corresponding cone-like recesses in the fifth array of cone-like recesses in the lower intermediate layer;

wherein the lower intermediate layer further comprises a sixth array of cone-like protuberances, wherein the core lower layer comprises a sixth array of cone-like recesses, wherein the cone-like protuberances in the sixth array of cone-like protuberances in the lower intermediate layer project into corresponding cone-like recesses in the sixth array of cone-like recesses in the core lower layer;

wherein the lower intermediate layer further comprises a seventh array of cone-like protuberances, wherein the lower outer layer comprises a seventh array of cone-like recesses, wherein the cone-like protuberances in the seventh array of cone-like protuberances in the lower intermediate layer project into corresponding cone-like recesses in the seventh array of cone-like recesses in the lower outer layer;

wherein the lower outer layer comprises an eighth array of cone-like protuberances, wherein the lower intermediate layer comprises an eighth array of cone-like recesses, wherein the cone-like protuberances in the eighth array of cone-like protuberances in the lower outer layer project into corresponding cone-like recesses in the eighth array of cone-like recesses in the lower intermediate layer;

wherein an outer upper surface of the compressible liner is smooth and continuous;

wherein at least one of said co-extensive layers has a different at least one of compressibility and density to that of an adjacent layer of said co-extensive layers;

wherein said co-extensive layers are each configured as one-piece and selected from foam expanded polystyrene and viscoelastic foam.

8. A helmet according to claim 1, 3, 4, 5, 6 or 7 wherein each layer of said coextensive layers defines a transverse direction, longitudinal direction and through thickness direction, said transverse direction, longitudinal direction and through thickness direction being mutually perpendicular; wherein one of the layers is divided along the transverse and longitudinal directions into elements, each element having an edge; and adjacent elements of said layer being interlockable to one another by means of complementary male and female locking structures or keys formed along the edge.

9. A helmet according to claim 8 wherein said locking structures or keys prevent transverse separation of the elements thereof.

10. A helmet according to claim 9 wherein said locking structures or keys comprises integral orthogonally engageable male and female members.

11. A helmet according to claim 1, 3, 4, 5, 6, or 7, wherein at least one of the protuberances of one of the layers of said coextensive layers protrudes to the surface of an adjacent one of the layers of said coextensive layers.

12. A helmet according to claims 1, 3, 4, 5, or 6, wherein the outer layer has a density in a range from 35-110 $kgm^{-3}$, the intermediate layer has a density in a range from 15-100 $kgm^{-3}$, and the inner layer has a density in a range from 15-90 $kgm^{-3}$.

13. A helmet according to claim 12 wherein the intermediate layer has isotropic or anisotropic properties.

* * * * *